US008851942B2

(12) United States Patent
Yoshikawa et al.

(10) Patent No.: US 8,851,942 B2
(45) Date of Patent: Oct. 7, 2014

(54) THRUST GENERATING APPARATUS

(75) Inventors: Keiichi Yoshikawa, Kakogawa (JP); Hiromitsu Kiyose, Kobe (JP); Tetsuro Ikebuchi, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 1106 days.

(21) Appl. No.: 12/810,784

(22) PCT Filed: Dec. 16, 2008

(86) PCT No.: PCT/JP2008/003793
§ 371 (c)(1),
(2), (4) Date: Jul. 22, 2010

(87) PCT Pub. No.: WO2009/084168
PCT Pub. Date: Jul. 9, 2009

(65) Prior Publication Data

US 2010/0279559 A1 Nov. 4, 2010

(30) Foreign Application Priority Data

Dec. 28, 2007 (JP) ..... 2007-341193

(51) Int. Cl.

| | |
|---|---|
| ***B63H 21/17*** | (2006.01) |
| ***B63H 11/00*** | (2006.01) |
| ***F04B 35/04*** | (2006.01) |
| ***B63H 11/08*** | (2006.01) |
| ***B63H 5/14*** | (2006.01) |
| ***B63H 23/24*** | (2006.01) |
| *B63H 5/125* | (2006.01) |
| *B63H 1/16* | (2006.01) |
| *B63H 23/00* | (2006.01) |
| *B63H 5/10* | (2006.01) |

(52) U.S. Cl.

CPC ..... *B63H 11/08* (2013.01); *B63H 5/125* (2013.01); *B63H 2001/165* (2013.01); *B63H 2023/005* (2013.01); *B63H 5/14* (2013.01); *B63H 5/10* (2013.01); *B63H 23/24* (2013.01)

USPC ..... 440/6; 440/39; 60/221; 417/356

(58) Field of Classification Search

USPC ..... 60/221; 310/114; 417/423.1; 440/6

See application file for complete search history.

(56) References Cited

U.S. PATENT DOCUMENTS 3,143,972 A * 8/1964 Smith et al. ..... 417/356
5,185,545 A * 2/1993 Veronesi et al. ..... 310/114

(Continued)

FOREIGN PATENT DOCUMENTS

CN 1433366 A 7/2003
EP 1739007 1/2007

(Continued)

OTHER PUBLICATIONS

ISA Japan, International Search Report of PCT/JP2008/003793, Mar. 31, 2009, 3 pages.

*Primary Examiner* — Lindsay Low
*Assistant Examiner* — Syed O Hasan
(74) *Attorney, Agent, or Firm* — Alleman Hall McCoy Russell & Tuttle LLP

(57) ABSTRACT

A thrust generating apparatus which is positioned under water and configured to generate a thrust by ejecting water includes a duct-shaped stator provided with a plurality of armature coils, and a plurality of ring-shaped rotors which are arranged radially inward of the stator and provided with permanent magnets respectively corresponding to the plurality of armature coils, wherein the plurality of rotors are arranged in series in a rotational axis direction thereof and each of the rotors has a propeller vane protruding radially inward. A thrust generating apparatus is capable of outputting a high driving power without increasing a propeller diameter.

15 Claims, 14 Drawing Sheets

(56) References Cited

U.S. PATENT DOCUMENTS

| | | | | |
|---|---|---|---|---|
| 5,209,650 | A | 5/1993 | Lemieux | |
| 5,252,875 | A * | 10/1993 | Veronesi et al. | 310/114 |
| 6,692,319 | B2 | 2/2004 | Collier et al. | |
| 6,837,757 | B2 * | 1/2005 | Van Dine et al. | 440/6 |
| 2003/0153217 | A1 | 8/2003 | Tornblad et al. | |

FOREIGN PATENT DOCUMENTS

| | | |
|---|---|---|
| JP | 62-006892 | 1/1987 |
| JP | 62006892 | 1/1987 |
| JP | 62-037296 | 2/1987 |
| JP | 62037296 | 2/1987 |
| JP | 2003-246298 | 9/2003 |
| JP | 2003-328988 | 11/2003 |

* cited by examiner

THRUST GENERATING APPARATUS

TECHNICAL FIELD

The present invention relates to a thrust generating apparatus configured to generate a propulsive force of a vessel.

BACKGROUND ART

In recent years, vessels have been required to improve the efficiency of a propulsive apparatus configured to generate a propulsive force, in view of shortage of energy resources or the like. Under the present circumstances in which shipboard devices have been changed from hydraulically-operated devices to motor-operated devices, a propulsive apparatus that generates the propulsive force with a motor has been increasingly employed rather than a conventional propulsive apparatus directly coupled to a main engine. For example, U.S. Pat. No. 6,692,319 discloses a propulsive apparatus for submarines/submersible vessels that includes a ring-shaped motor rotor provided with propeller vanes protruding radially inward thereof. According to this propulsive apparatus, water is ejected by the rotation of the propeller vanes through a space defined by the ring-shaped motor to generate a propulsive force.

DISCLOSURE OF THE INVENTION

Problem to be Solved by the Invention

If contemplation is made to apply the submarine/submersible vessel propulsive apparatus as disclosed in U.S. Pat. No. 6,692,319 to, for example, a standard vessel, it is required to make an arrangement such that the propulsive apparatus protruding downward from the vessel does not hit the sea bottom when the vessel is entering a port. In that case, since the ring-shaped motor is located radially outward relative to the propeller vanes, the propeller diameter cannot be increased so much. However, propeller vanes of a smaller diameter generate a smaller propulsive force, giving rise to a problem that the propulsive apparatus has insufficient efficiency and driving power.

Accordingly, an object of the present invention is to provide a thrust generating apparatus which has a high efficiency and is capable of providing a high driving power without increasing a propeller diameter.

Means to Solve the Problem

A thrust generating apparatus of the present invention is a thrust generating apparatus which is positioned under water and configured to generate a thrust by ejecting water, comprising a duct-shaped stator provided with a plurality of coils; and a plurality of ring-shaped rotors which are arranged radially inward relative to the stator and provided with magnets respectively corresponding to the plurality of coils, wherein the plurality of rotors are arranged in series in a rotational axis direction thereof and each of the rotors has a propeller vane protruding radially inward.

According to the above configuration, by a magnetic field generated by a current supplied to each coil, the rotors attached to magnets rotate and the plurality of propeller vanes rotate. Since these propeller vanes are arranged in series in their rotational axis direction (water flow direction), the water that flows into the duct-shaped stator is continuously ejected by the plurality of propeller vanes, thereby achieving a sufficient propulsive force. In addition, by providing a plurality of propeller vanes, the load is dispersed to the respective propeller vanes. This suppresses the generation of cavitation or the like. Therefore, it becomes possible to efficiently generate a propulsive force without increasing the propeller diameter.

The above plurality of rotors may be configured such that a propeller vane on a downstream side rotates in an opposite direction to rotation of a propeller vane on an upstream side.

According to the above configuration, when a straight-line flow contributing to propulsion and a swirl flow, which does not contribute thereto, are generated at the upstream propeller vane, the swirl flow is guided to turn to a straight-line flow by the downstream propeller vane rotating in the opposite direction. Hence, it becomes possible to further improve the thrust generation efficiency.

The thrust generating apparatus may further comprise a boss positioned along a center axis of the above rotors.

According to the above configuration, since the center region of a cylindrical space defined by the duct-shaped stator is occupied by the boss, a passage area for the water that acts on the propeller vanes is reduced and thereby the flow velocity thereof is increased. As a result, the propulsive force of the thrust generating apparatus increases, making it possible to further improve the thrust generation efficiency.

The boss may be a fixed boss connected to the stator, and the fixed boss may have a diameter smaller than a diameter defined by radially inward tip ends of the plurality of propeller vanes, and the plurality of propeller vanes may be configured to rotate along an outer peripheral surface of the fixed boss.

According to the above configuration, since the fixed boss is fixedly mounted on the center axis of the rotors and the propeller vanes rotate separately from the fixed boss, the weight of the rotors is reduced, making it possible to further improve the thrust generation efficiency.

The thrust generating apparatus may further comprise a guide vane configured to guide water to the propeller vanes, and the guide vane may be fixedly mounted to couple the stator to the fixed boss.

According to the above configuration, since the water that has passed through the guide vane is guided to flow toward the surfaces of the propeller vanes, it becomes possible to efficiently rotate the propeller vanes. In addition, since the guide vane also serves as a member for connecting the fixed boss to the stator, the number of components can be reduced.

The above boss may be a rotatable boss which is connected to radially inward tip ends of the propeller vanes and configured to integrally rotate with the propeller vanes, the rotatable boss may include a plurality of rotatable bosses respectively corresponding to the propeller vanes, and the rotatable bosses may be configured to rotate independently of each other.

According to the above configuration, with the rotatable bosses connected to the propeller vanes respectively, the propeller vanes can freely rotate independently of each other.

The above boss may have a shape in which an outer diameter increases from an upstream side to a downstream side.

According to the above configuration, since a passage sectional area gradually decreases from upstream toward downstream, the flow velocity of the water ejected by the propeller vanes increases. As a result, the propulsive force of the thrust generating apparatus increases, making it possible to further improve the thrust generation efficiency.

The above boss may be extended to protrude in a downstream direction beyond a downstream end of the stator.

According to the above configuration, the water ejected by the propeller vanes is guided along the boss for some time after passing through the downstream end of the stator. As a result, a reduction in the propulsive force due to a wake flow is prevented, making it possible to further improve the thrust generation efficiency.

The portions of the stator respectively corresponding to the plurality of rotors may be coupled to each other in series in a water flow direction such that the portions of the stator are individually dismountable.

According to the above configuration, since units having the stator and rotors can be dismounted individually, maintenance is easily carried out.

The above stator may include a plurality of ring-shaped casings configured to respectively accommodate the plurality of coils and an annular coupling member interposed between the casings and having a concave portion formed in an outer peripheral surface thereof, and side walls of the concave portion of the annular coupling member and the casings may be fastened together with bolts.

According to the above configuration, by merely removing a bolt at the concave portion of the annular coupling member, units having the stator and rotors can be dismounted individually. Thus, maintenance is easily carried out.

The thrust generating apparatus may further include a water-lubricated bearing which is disposed to face a side surface and outer peripheral surface of the rotor and configured to sustain loads in a thrust direction and in a radial direction, a water intake which is formed in the stator at a position downstream of the propeller vanes and configured to take in water that has passed through the propeller vanes, and a water guide pipe configured to guide water that flows into the water intake to the water-lubricated bearing.

According to the above configuration, since a water-lubricated bearing which uses no lubricating oil is employed, there is no fear of contaminating the sea or the like, or a seal structure for the lubricating oil may be omitted. This obviates a need for complicated maintenance. In addition, by a static pressure difference between the water intake and the water-lubricated bearing, water can be supplied to the water-lubricated bearing without a pump, making it possible to reduce the components in number and to dispense with a power for driving the pump. This leads to improved energy efficiency in the whole apparatus. Alternatively, a pump may be used as a pressure source for supplying water to the water-lubricated bearing.

The above water guide pipe may be connected to a water discharge hole formed in an end surface of the water-lubricated bearing which is opposite to an upstream end surface of the rotor.

According to the above configuration, the water discharged from the water discharge hole can oppose the load in the thrust direction applied to the rotor, making it possible to reduce a frictional resistance at the upstream end surface of the rotor.

The above water guide pipe may be configured such that it is positioned inside an object in a state where the thrust generating apparatus is mounted to the object.

According to the above configuration, since the water guide pipe is not exposed but protected by the object, damages which would otherwise be caused by foreign matters present in water can be prevented.

BEST MODE FOR CARRYING OUT THE INVENTION

Embodiments of the present invention will now be described with reference to the drawings.

Embodiment 1

Figure 1:
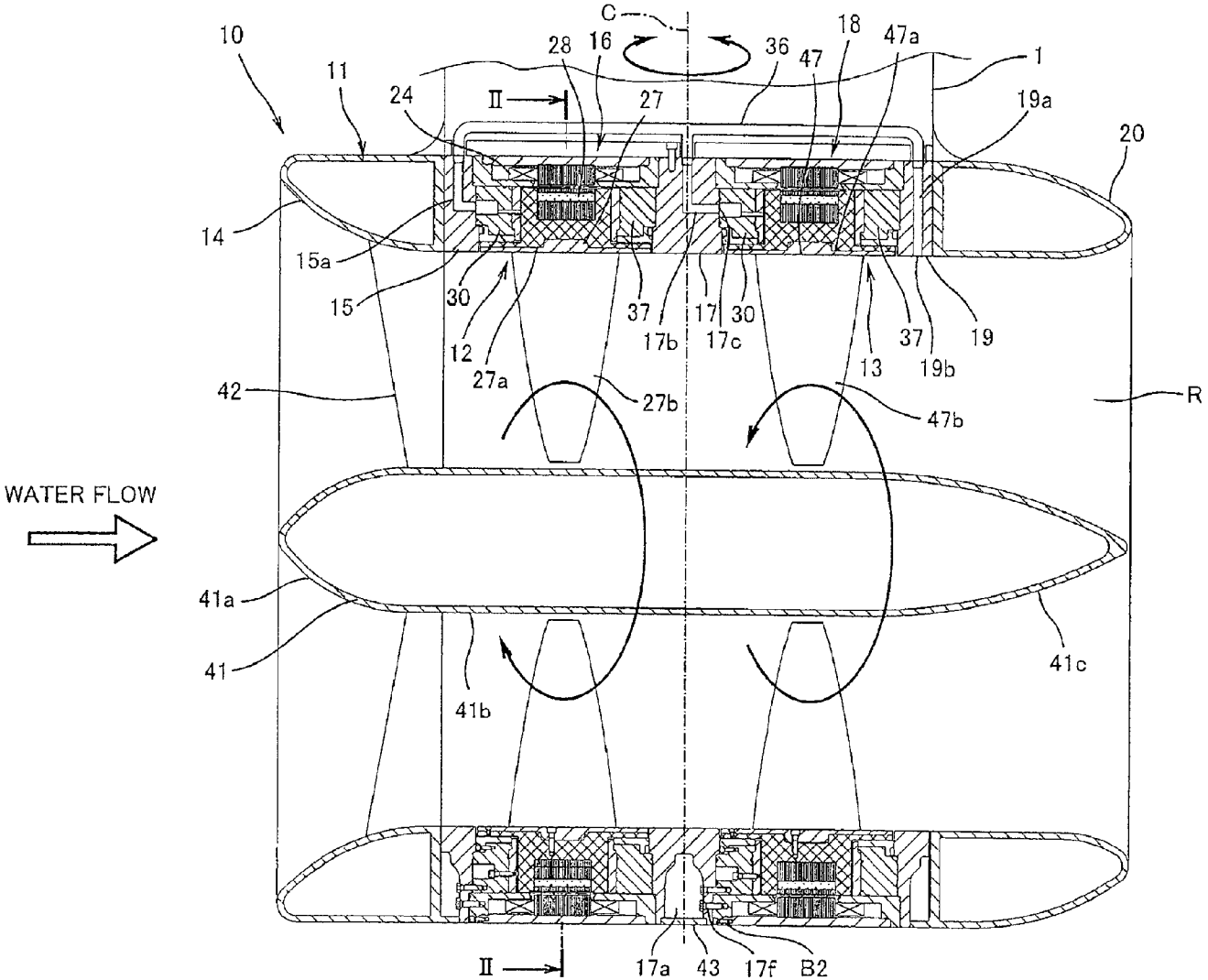
FIG. 1 is a vertical sectional view of a thrust generating apparatus according to a first embodiment of the present invention.
Figure 2:
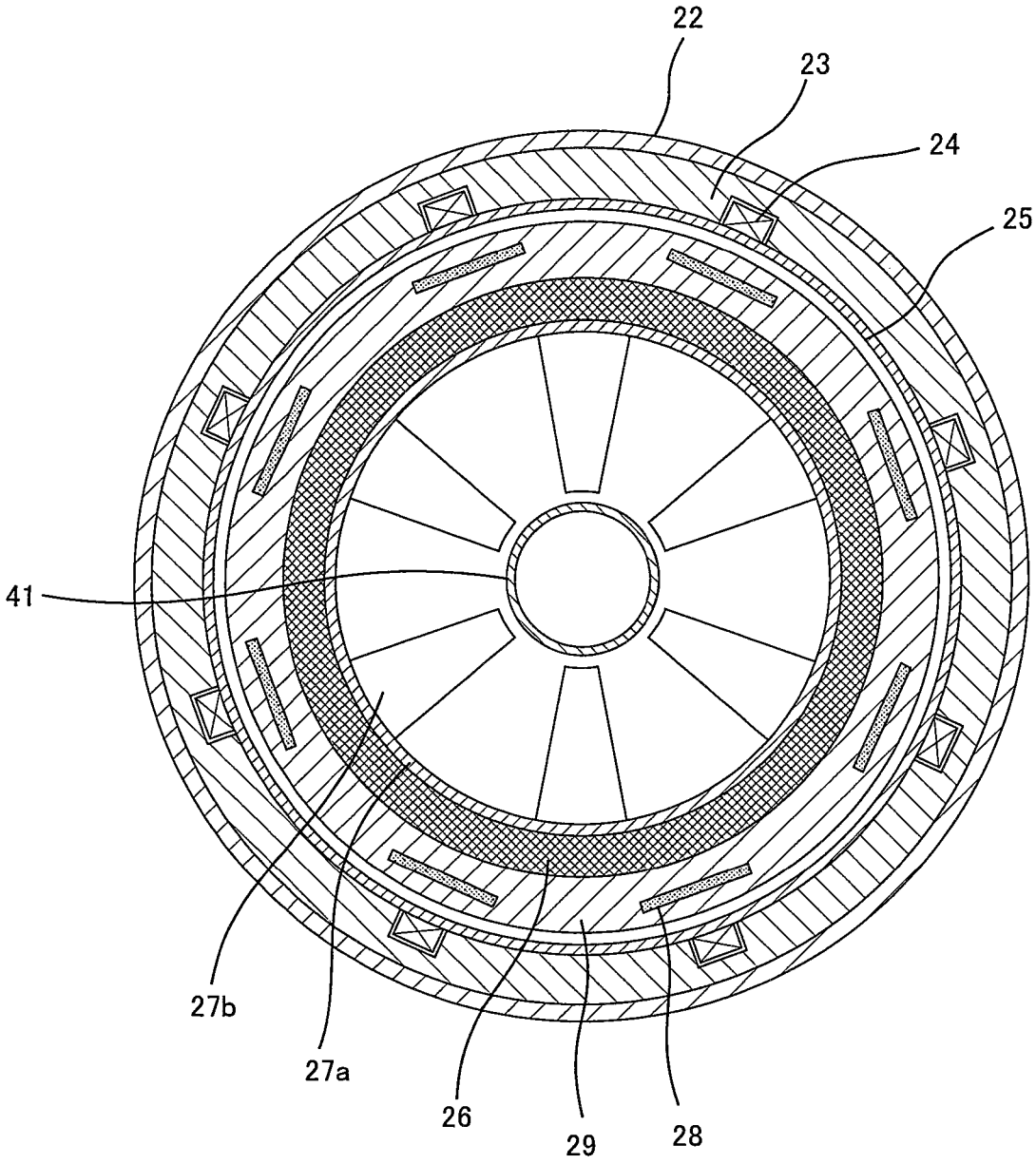
FIG. 2 is a cross-sectional view taken along the line II-II in FIG. 1.
Figure 3:
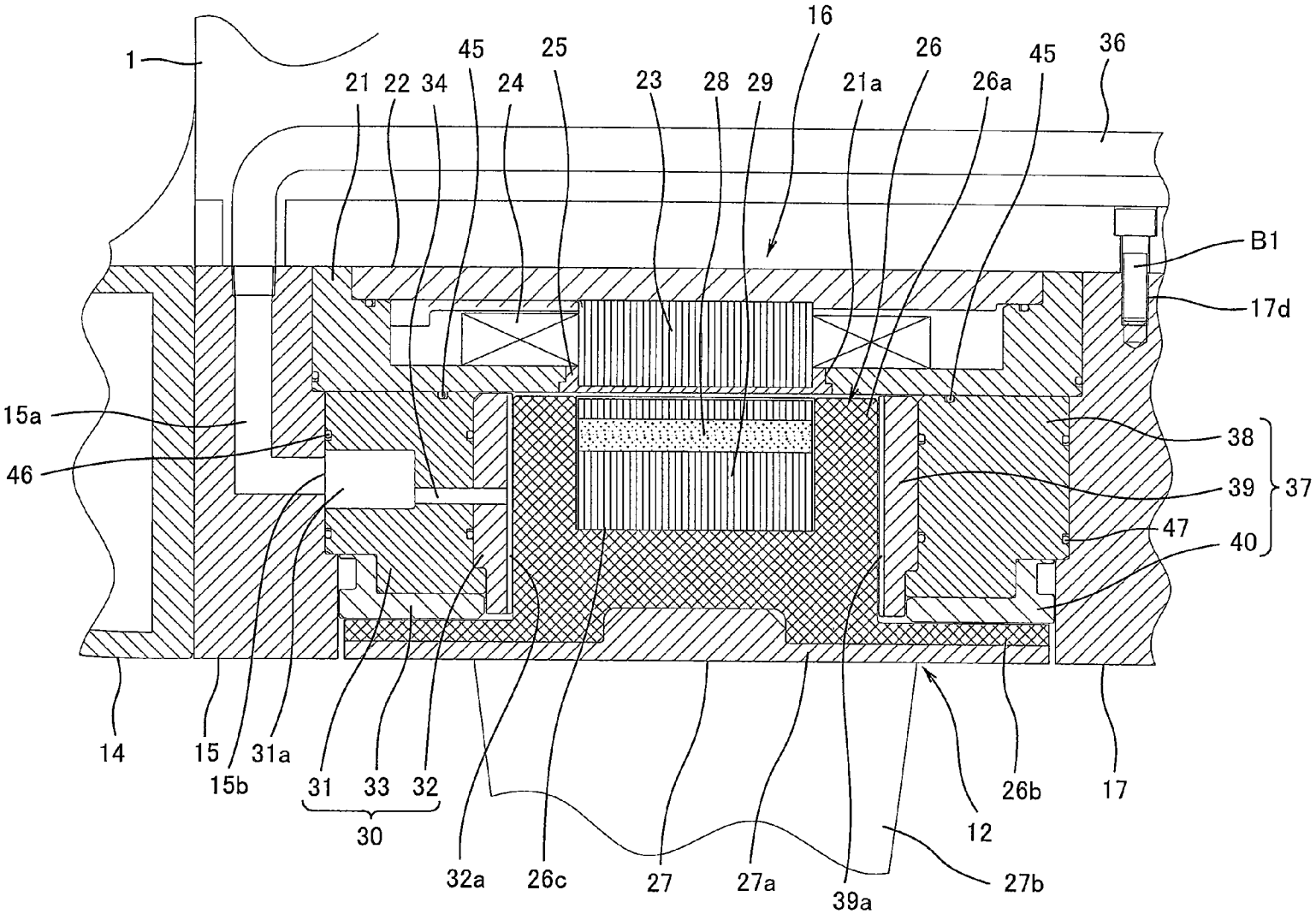
FIG. 3 is a partial enlarged cross-sectional view of the thrust generating apparatus of FIG. 1.
Figure 4:
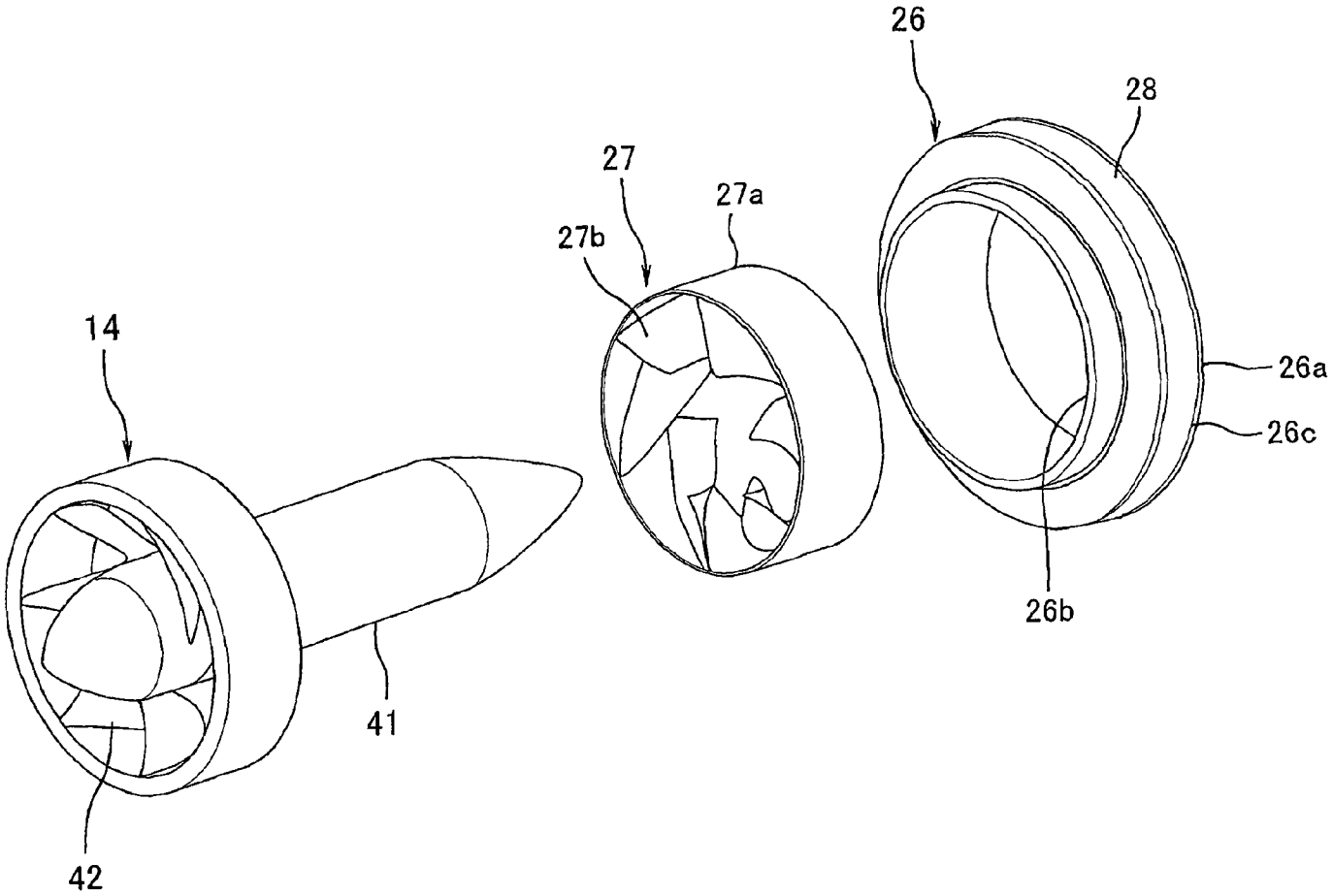
FIG. 4 is a partially exploded perspective view of the thrust generating apparatus of FIG. 1.
Figure 5:
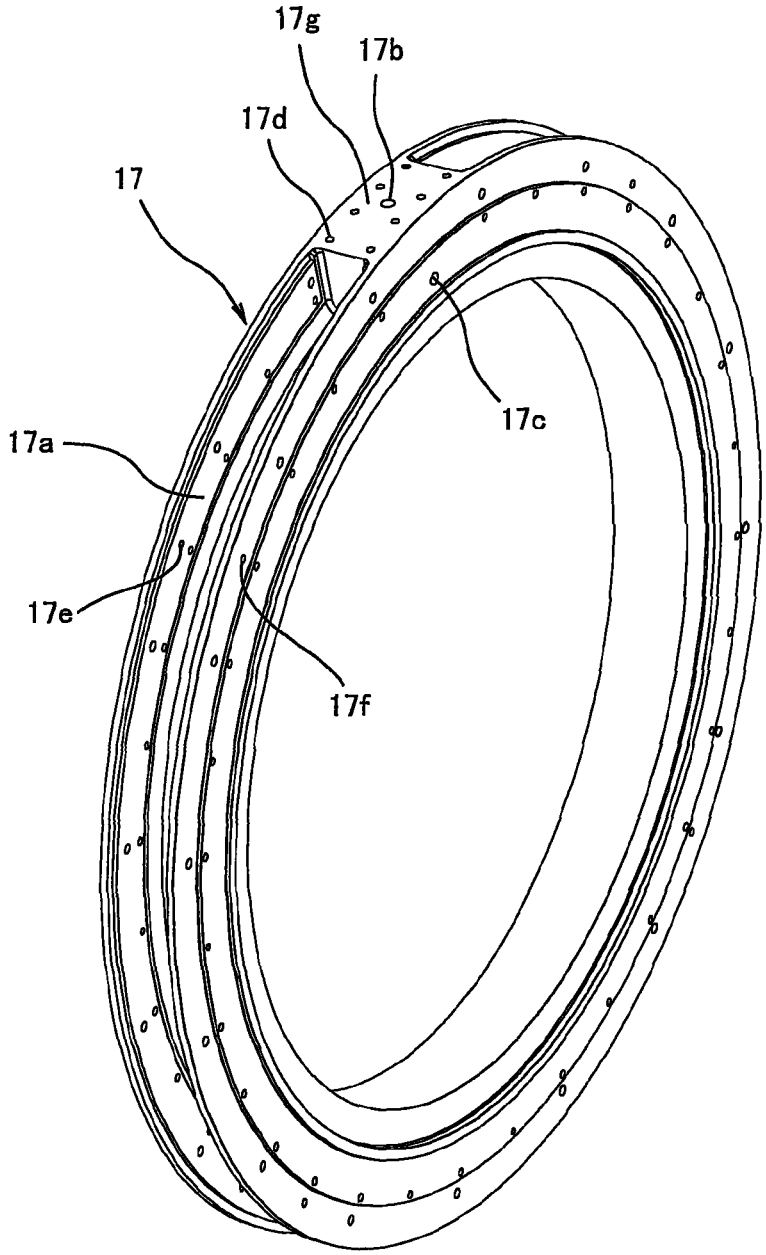
FIG. 5 is a perspective view of an annular coupling member of the thrust generating apparatus of FIG. 1.

FIG. 1 is a vertical sectional view of a thrust generating apparatus 10 according to a first embodiment of the present invention. FIG. 2 is a cross-sectional view taken along the line II-II in FIG. 1. FIG. 3 is a partial enlarged cross-sectional view of the thrust generating apparatus 10 of FIG. 1. FIG. 4 is a partially exploded perspective view of the thrust generating apparatus 10 of FIG. 1. FIG. 5 is a perspective view of an annular coupling member 17 of the thrust generating apparatus 10 of FIG. 1.

As shown in FIGS. 1 and 2, the thrust generating apparatus 10 is mounted to a mobile object capable of relative movement on or under water with respect to the water and, for example, to a lower end portion of a strut 1 protruding downward from a vessel bottom portion, such that the thrust generating apparatus 10 is rotatable around a rotational axis C extending in a vertical direction. To be specific, the vessel is configured to be steered according to the rotation of the thrust generating apparatus 10 around the rotational axis C. This thrust generating apparatus 10 includes a duct-shaped stator 11 fixed to the strut 1 and a pair of annular rotors 12, 13 which are positioned radially inward relative to the stator 11 and arranged in series with each other in a water flow direction. To be specific, in the thrust generating apparatus 10, a pair of annular motor units 16, 18 are arranged in series in the rotational axis direction of the rotors 12, 13. The stator 11 is composed of, in the order from upstream side, an inflowing tubular body 14, an annular bearing support member 15, a fixed portion of the first motor unit 16, an annular coupling member 17, a fixed portion of the second motor unit 18, an annular bearing support member 19, and an outflowing tubular body 20 which are coupled to one another.

As shown in FIG. 3, the first motor unit 16 has a first casing 21 of a flanged cylinder shape, a stator core 23 which serves as a magnetic flux path is located in an annular cut portion 21*a* at the center of the first casing 21 in the water flow direction, and an armature coil 24 is wound around the stator core 23. This armature coil 24 is connected via an electric wire (not shown) installed inside the strut 1 to an electric power supply (not shown) built into the vessel. The outer peripheral opening of the first casing 21 is closed with a cylinder-shaped second casing 22. A thin-walled can 25 which is formed from a material of small eddy-current loss and has insulative and water-resistance properties is attached on the inner peripheral surface of the stator core 23. A runner 26, forming a part of the rotor 12, is located radially inward relative to the can 25 with a small gap therebetween.

As shown in FIGS. 3 and 4, the runner 26 has a ring-shaped portion 26*a* provided with an annular recess 26*c* on its outer peripheral surface and a flange 26*b* protruding at both sides in the water flow direction from the inner peripheral end of the ring-shaped portion 26*a*. A yoke 29 serving as a magnetic flux path is buried in the annular recess 26*c*. A plurality of permanent magnets 28 are buried in the yoke 29 such that they are circumferentially equally spaced apart from one another with alternate polarities so as to correspond to the stator core 23.

A propeller member 27 is mounted to the inner peripheral surface of the runner 26. The propeller member 27 has a cylindrical portion 27*a* internally fitted to the runner 26 and a plurality of propeller vanes 27*b* protruding radially inward from the inner peripheral surface of the cylindrical portion 27*a* such that they are circumferentially equally spaced apart from one another. To be specific, the radially inward tip end of each propeller vane 27*b* forms a free end. Furthermore, the diameter defined by radially inward tip ends of the propeller vanes 27*b* is set slightly larger than the outer diameter of a later-described fixed boss 41. Hence, the propeller vanes 27*b* are configured to rotate along the outer peripheral surface of the fixed boss 41 with an appropriate tip clearance therebetween.

As shown in FIG. 1, the fixed boss 41 is fixedly mounted on a center axis of the substantially cylindrical propeller members 27, 47 and is provided to continuously extend through the center of the upstream propeller member 27 and the center of the downstream propeller member 47. The fixed boss 41 is a streamlined hollow member including a diameter-increasing front end portion 41*a* having a diameter increasing in the water flow direction, a cylindrical portion 41*b* extending from the downstream side of the diameter-increasing front end portion 41*a* and having a substantially equal outer diameter in the water flow direction, and a diameter-decreasing rear end portion 41*c* extending from the downstream side of the cylindrical portion 41*b* and having a diameter decreasing in the water flow direction. The upstream end of the fixed boss 41 substantially conforms in position in the water flow direction to the upstream end of the stator 11, while the downstream end of the fixed boss 41 substantially conforms in position in the water flow direction to the downstream end of the stator 11. The fixed boss 41 is fixed to the inflowing tubular body 14 via a guide vane 42 located slightly downstream relative to the upstream end of the stator 11. The guide vane 42 is inclined in the opposite direction to the inclination of the propeller vane 27*b* and serves to guide a water flow. The guide vane 42 also serves as a guard grid for protection from driftwood or the like.

As shown in FIG. 3, a pair of water-lubricated bearings 30, 37 are interposed between the stator 11 and the rotor 12, and the rotor 12 is rotatably mounted to the bearings 30, 37. The water-lubricated bearings 30, 37 are arranged to face side surfaces of the ring-shaped portion 26*a* and the outer peripheral surface of the flange 26*b* of the runner 26 and are configured to sustain the loads applied to the rotor 12 in a thrust direction and in a radial direction. The water-lubricated bearings 30, 37 are supported, at the outer peripheral surfaces thereof which is on the opposite side of the flange 26*b* of the runner 26, with respect to the first casing 21 via an O-ring 45. The surface of the upstream water-lubricated bearing 30 which is on the opposite side of the ring-shaped portion 26*a* of the runner 26 is supported on the annular bearing support member 15 via an O-ring 46. The surface of the downstream water-lubricated bearing 37 which is on the opposite side of the ring-shaped portion 26*a* of the runner 26 is supported on the annular coupling member 17 via an O-ring 47. The O-rings 46, 47 thus arranged not only perform the sealing function, but also can elastically absorb the loads in the radial direction and in the thrust direction to alleviate an impact force.

The water-lubricated bearings 30, 37 include a ring-shaped base 31, 38, a thrust slide member 32, 39 mounted to the surface of a base 31, 38 which is opposite to the ring-shaped portion 26*a* of the runner 26, and a radial slide member 33, 40 mounted to the surface of the base 31, 38 which is opposite to the flange 26*b* of the runner 26. On the surface of the thrust slide member 32 which is opposite to the runner 26, radially extending grooves 32*a* are formed at circumferentially equal intervals. On the surface of the thrust slide member 39 which is opposite to the runner 26, radially extending grooves 39*a* are formed at circumferentially equal intervals. The surfaces of the thrust slide member 32, 39 and radial slide member 33, 40 are formed of ceramic. However, the thrust slide member 32, 39 and radial slide member 33, 40 may themselves be made of solid ceramic.

The upstream annular bearing support member 15 is provided with a water guide passage 15*a* connected to a later-described water guide pipe 36. This annular bearing support member 15 has, in an end surface opposite to the upstream water-lubricated bearing 30, an opening 15*b* connected to the water guide passage 15*a*. The upstream water-lubricated bearing 30 has a ring-shaped common space 31*a* which is connected to the opening 15*b* and recessed on the surface opposite to the annular bearing support member 15. On an end surface of the upstream water-lubricated bearing 30 that is opposite to the ring-shaped portion 26*a* of the runner 26, a plurality of circumferentially equally spaced water discharge holes 34 are formed, and these water discharge holes 34 are connected to the one common space 31*a*. In addition, the water-lubricated bearings 30, 37 are arranged such that they are closer to the runner 26 than the upstream end and downstream end of the first casing 21, respectively and the annular bearing support member 15 and the annular coupling member 17 are fitted to the resulting step shapes, respectively.

As shown in FIG. 5, the annular coupling member 17 is formed on its outer peripheral surface with a concave portion 17 except for a mounting portion 17*g*. In other words, the mounting portion 17*g* is provided to make the concave portion 17 discontinuous at a portion thereof in the circumferential direction. The mounting portion 17*g* is formed with one water guide passage 17*b* and a plurality of bolt holes 17*d*. A bolt B1 (see FIG. 3) for fastening the annular coupling member 17 to the strut 1 is inserted into the bolt hole 17*d*. The water guide passage 17*b* is formed in an L shape in cross-section (see FIG. 1). On an end surface of the second motor unit 18 which is facing the upstream water-lubricated bearing 30, an opening 17*c* is formed to be connected to the water guide passage 17*b*. Bolt holes 17*e*, 17*f* for bolting the annular coupling member 17 to each of the first casings 21 of the first and second motor units 16, 18 are formed on the both side walls of the concave portion 17*a*. That is, the concave portion 17 serves as a work space to allow bolts to be inserted into and taken out of the bolt holes 17*e*, 17*f*. The concave portion 17*a* is closed with a cover 43 (see FIG. 1).

As shown in FIG. 1, the basic configuration of the second motor unit 18 is almost identical to that of the first motor unit 16, and its detailed description will be omitted. However, the propeller vane 47*b* mounted to the rotor 13 of the second motor unit 18 is inclined in an opposite direction to the inclination of the propeller vanes 27*b* mounted to the rotor 12 of the first motor unit 16. In addition, the rotor 13 of the second motor unit 18 is configured to rotate in the opposite direction to the rotation of the rotor 12 of the first motor unit 16. This allows the downstream propeller vane 47*b* to rotate in an opposite direction to the rotation of the upstream propeller vane 27*b*, so that a swirl flow generated at the upstream propeller vane 27*b* is guided into a straight flow at the downstream propeller vane 47*b* and the energy of the swirl flow generated at the upstream propeller vane 27*b* is efficiently used at the downstream propeller vane 47*b*. The tandem-type thrust generating apparatus 10 is thus configured with the propeller vane 27*b* and propeller vane 47*b* arranged in series in the water flow direction.

Furthermore, a water intake 19*b* is formed in the annular bearing support member 19 downstream relative to the second motor unit 18 and opens into a main passage R where the pair of propeller vanes 27*b*, 47*b* are arranged. This water intake 19*b* is formed in the stator 11 at a position downstream of the downstream propeller vane 47*b*, and a water guide passage 19*a* is provided to penetrate the annular bearing support member 19 from the water intake 19*b* toward the outer peripheral surface. One end of the water guide pipe 36 is connected to the opening of the water guide passage 19*a* on the outer peripheral side thereof. The water guide pipe 36 is branched into two portions toward its other end. One end of the branched portions is connected to the water guide passage 17*b* of the annular coupling member 17 located upstream of the downstream propeller vane 47*b*, while the other end is connected to the water guide passage 15*a* of the annular bearing support member 15 located upstream of the upstream propeller vane 27*b*. This water guide pipe 36 is protectively disposed inside the strut 1. When the rotors 12, 13 are rotated, the pressure of flow on the downstream side of the propeller vane 47*b* is higher than the pressure of flow on its upstream side, and the resulting pressure difference allows the water passing through the main passage R to be guided through the water intake 19*b* into the water guide pipe 36 without a presence of a pump and supplied through the water guide passages 15*a*, 17*b* to the water-lubricated bearings 30, 37, respectively.

Next, the operation of the thrust generating apparatus 10 will be described. As shown in FIG. 1, upon flowing currents in opposite directions through the armature coil 24 of the first motor unit 16 and through the armature coil 24 of the second motor unit 18, and causing the upstream rotor 12 and the downstream rotor 13 to rotate in the opposite directions, the upstream propeller vane 27*b* and the downstream propeller vane 47*b* rotate in the opposite directions. Thereupon, water is drawn into the main passage R inside the stator 11 from left side in FIG. 1 by the upstream propeller vane 27*b*. This water flow is guided radially outward along the streamlined fixed boss 41 and its flow velocity increases because of a decrease in the passage area. Then, the water flow is guided by the guide vane 42 so that it impinges on the upstream propeller vane 27*b* at an appropriate inflowing angle, and a straight-line flow which contributes to propulsion and a swirl flow which does not contribute to propulsion are generated at the propeller vane 27*b*. Then, the energy of the swirl flow is efficiently used at the downstream propeller vane 47*b* rotating in the opposite direction such that the swirl flow turns to a straight-line flow. Thereafter, the water that has passed through the downstream propeller vane 47*b* and has an increased pressure flows along the fixed boss 41 and is ejected rearward from the downstream end of the stator 11.

According to the configuration as described above, since the propeller vanes 27*b*, 47*b* are arranged in series on an upstream side and a downstream side in the water flow direction, the water guided into the duct-shaped stator 11 is continuously ejected by the respective propeller vanes 27*b*, 47*b* to provide a sufficient propulsive force. In addition, since the provision of a plurality of propeller vanes 27*b*, 47*b* allows a load to be dispersed to the respective upstream and downstream propeller vanes 27*b*, 47*b*, generation of cavitation or the like is suppressed. Furthermore, the downstream propeller vane 47*b* rotates in the opposite direction to the rotation of the upstream propeller vane 27*b*. Therefore, even when a straight-line flow and a swirl flow are generated at the upstream propeller vane 27*b*, the energy of the swirl flow is efficiently used at the downstream propeller vane 47*b* rotating in the opposite direction.

Moreover, since the center region of the main passage R defined by the duct-shaped stator 11 is occupied by the fixed boss 41, a passage area for the water that acts on the propeller vanes 27*b*, 47*b* is reduced, increasing its flow velocity. In addition, since the fixed boss 41 is fixedly mounted on the center axis of the rotors 12, 13 and the propeller vanes 27*b*, 47*b* rotate separately from the fixed boss 41, the weight of the rotors 12, 13 is reduced. Furthermore, the water discharge hole 34 of the upstream water-lubricated bearing 30 is opposite to the upstream end surface of the runner 26, and the water discharged from the water discharge hole 34 can oppose the load in the thrust direction applied to the runner 26, thereby alleviating a frictional resistance at the upstream end surface of the runner. Based on the foregoing, a propulsive force can be efficiently generated without increasing the diameter of the propeller.

Since the guide vane 42 for guiding the water flow to the propeller vane 27*b* also serves as the member for connecting the fixed boss 41 to the stator 11, the components can be reduced in number. In addition, since the water-lubricated bearings 30, 37 which do not use lubricating oil are employed, there is no fear of contaminating the sea or the like, and the structure for the lubricating oil may be omitted. This eliminates a need for maintenance. Moreover, owing to the static pressure difference between the water intake 19*b* and the water-lubricated bearings 30, 37, water can be supplied to the water-lubricated bearings 30, 37 without a presence of a pump. This reduces the components in number, obviates a need for pump-driving power, and improves energy efficiency in the entire apparatus.

In addition, since the portions of the stator 11 that respectively correspond to the plurality of rotors 12, 13, i.e., the first and second motor units 16, 18 are arranged in series in the water flow direction via the annular coupling member 17 and are individually dismountable by removing the bolt B2 to detach the annular coupling member 17, maintenance and assembly are easily carried out. In addition, in the present embodiment, since the guide vane 42 is mounted only upstream relative to the propeller vanes 27*b*, 47*b*, but not between the upstream propeller vane 27*b* and the downstream propeller vane 47*b*, the distance between the two propeller vanes 27*b*, 47*b* may be made short, thereby reducing an apparatus size in the water flow direction. This leads to a reduction in a rotating torque generated when the strut 1 is rotating around the vertical rotational axis.

Alternatively, in order to improve water flow steering properties, a guide vane may be mounted between the upstream propeller vane 27*b* and downstream propeller vane 47*b*, and/or downstream of the propeller vanes 27*b*, 47*b*. In addition, although in the present embodiment, a pump is not employed as a pressure source for supplying water to the water-lubricated bearings 30, 37, such a pump may be used only during startup of the rotation of the propeller vanes or when forcibly supplying water to the water-lubricated bearings, or throughout an overall operation period.

Embodiment 2

Figure 6:
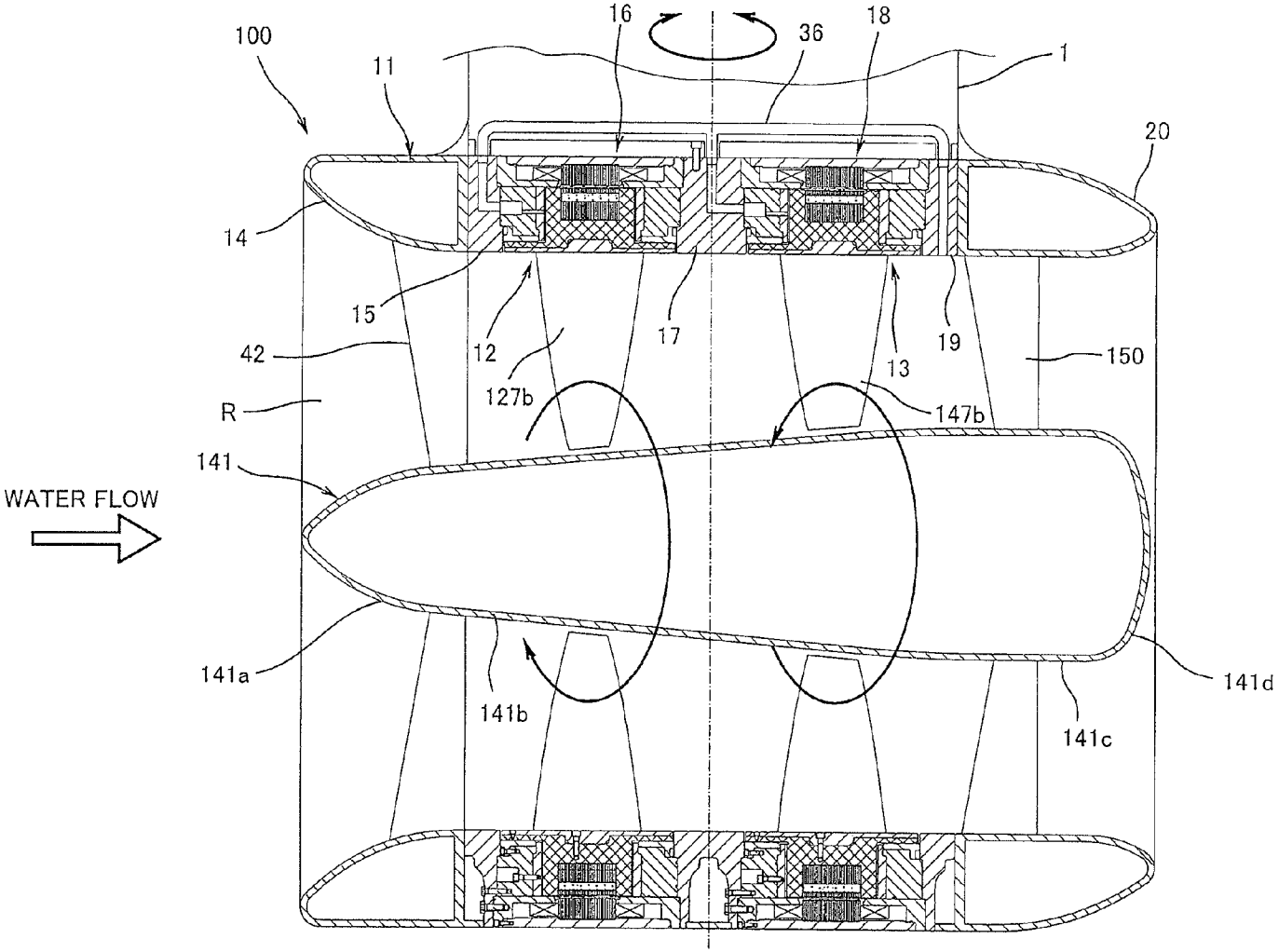
FIG. 6 is a vertical sectional view of a thrust generating apparatus according to a second embodiment of the present invention.

FIG. 6 is a vertical sectional view of a thrust generating apparatus 100 according to a second embodiment of the present invention. The constituents common to those in the previously described embodiment are designated by the same reference numerals and description thereof will be omitted. As shown in FIG. 6, the thrust generating apparatus 100 of the present embodiment includes a fixed boss 141 having a shape in which an outer diameter gradually increases from upstream side toward downstream side.

The fixed boss 141 includes a diameter-increasing front end portion 141*a* having a diameter increasing in the water flow direction, a conical cylindrical portion 141*b* extending from the downstream side of the diameter-increasing front end portion 141*a* and having an outer diameter gradually increasing from upstream side toward downstream side, a cylindrical portion 141*c* extending from the downstream side of the conical cylindrical portion 141*b* and having a substantially equal outer diameter in the water flow direction, and a diameter-decreasing rear end portion 141*d* extending from downstream side of the cylinder portion 141*c* and having a diameter abruptly decreasing in the water flow direction. The upstream end of the fixed boss 141 substantially conforms in position in the water flow direction to the upstream end of the stator 11, and the downstream end of the fixed boss 141 substantially conforms in position in the water flow direction to the downstream end of the stator 11.

The radially inward tip end of the propeller vane 127*b*, 147*b* is disposed along the outer peripheral surface of the fixed boss 141 with an appropriate tip clearance therebetween. A guide vane 42 is provided upstream relative to the upstream propeller vane 127*b*, and the front portion of the fixed boss 141 is fixed via the guide vane 42 to the inflowing tubular body 14. In addition, a guide vane 150 is provided downstream relative to the downstream propeller vane 147*b*, and the rear portion of the fixed boss 141 is fixed via the guide vane 150 to the outflowing tubular body 20. The guide vane 150 may be located between the upstream propeller vane 127*b* and the downstream propeller vane 147*b*.

According to the configuration as described above, a passage sectional area of the main passage R gradually decreases from upstream toward downstream, thereby increasing the velocity of the water ejected by the propeller vanes 127*b*, 147*b*. Hence, the propulsive force of the thrust generating apparatus 100 increases, making it possible to further improve the thrust generation efficiency.

Embodiment 3

Figure 7:
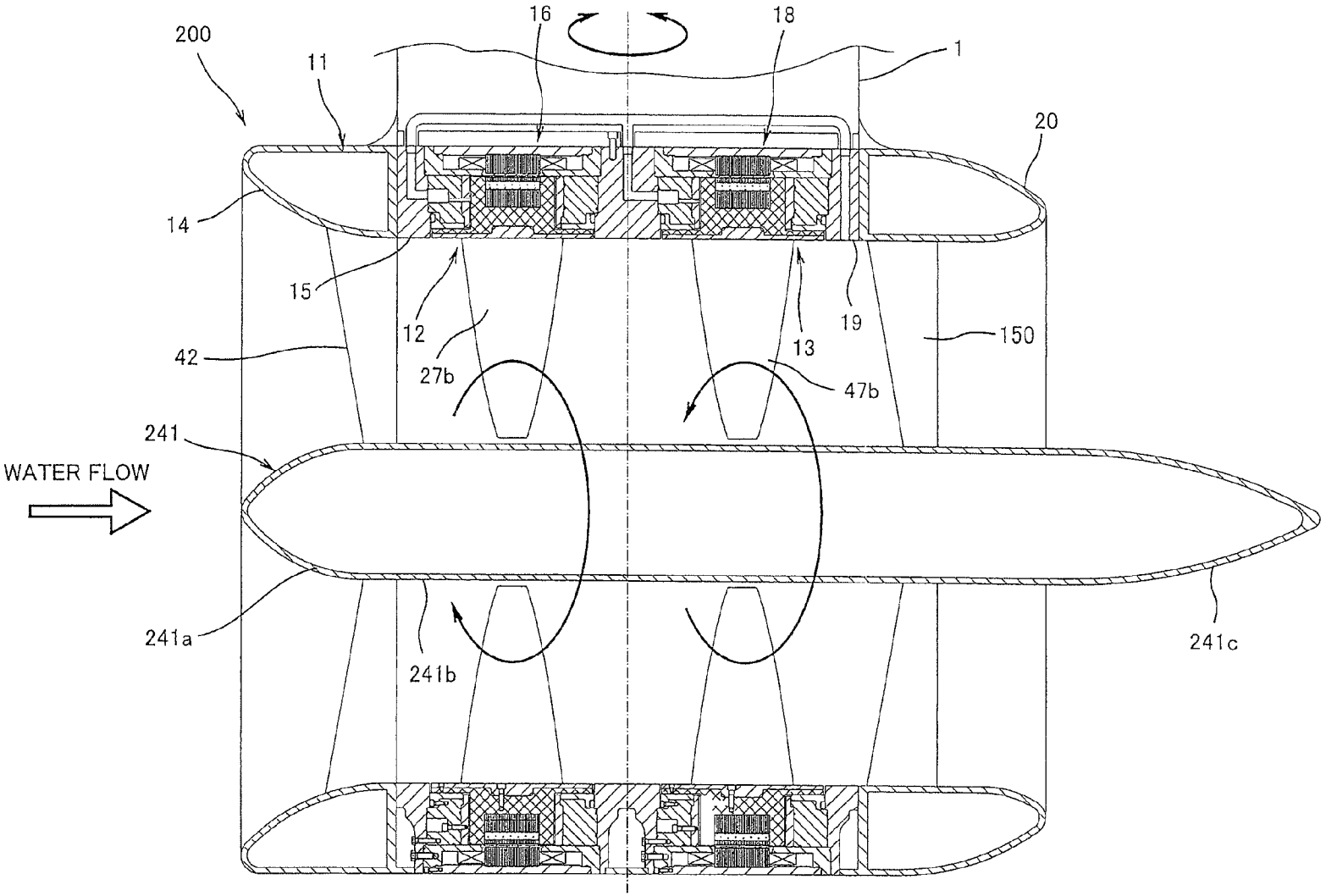
FIG. 7 is a vertical sectional view of a thrust generating apparatus according to a third embodiment of the present invention.

FIG. 7 is a vertical sectional view of a thrust generating apparatus 200 according to a third embodiment of the present invention. The constituents common to those in the previously described embodiments are designated by the same reference numerals and description thereof will be omitted. As shown in FIG. 7, the thrust generating apparatus 200 of the present embodiment includes a fixed boss 241 extended downstream beyond the downstream end of the stator 11.

The fixed boss 241 includes a diameter-increasing front end portion 241*a* having a diameter increasing in the water flow direction, a cylindrical portion 241*b* extending from the downstream side of the diameter-increasing front end portion 241*a* and having a substantially equal outer diameter in the water flow direction, and a diameter-decreasing rear end portion 241*c* extending from the downstream side of the cylindrical portion 241*b* and having a diameter decreasing in the water flow direction. The upstream end of the fixed boss 241 substantially conforms in position in the water flow direction to the upstream end of the stator 11. The portion of the fixed boss 241 that protrudes downstream beyond the downstream end of the stator 11 is composed of a rear portion of the cylindrical portion 241*b* and the diameter-decreasing rear end portion 241*c*.

According to the configuration as described above, the water ejected by the propeller vanes 27*b*, 47*b* is guided by the fixed boss 241 for some time after passing through the downstream end of the stator 11. Therefore, a reduction in the propulsive force which would otherwise occur due to a wake flow is prevented, and as a result, the thrust generation efficiency is further improved.

Embodiment 4

Figure 8:
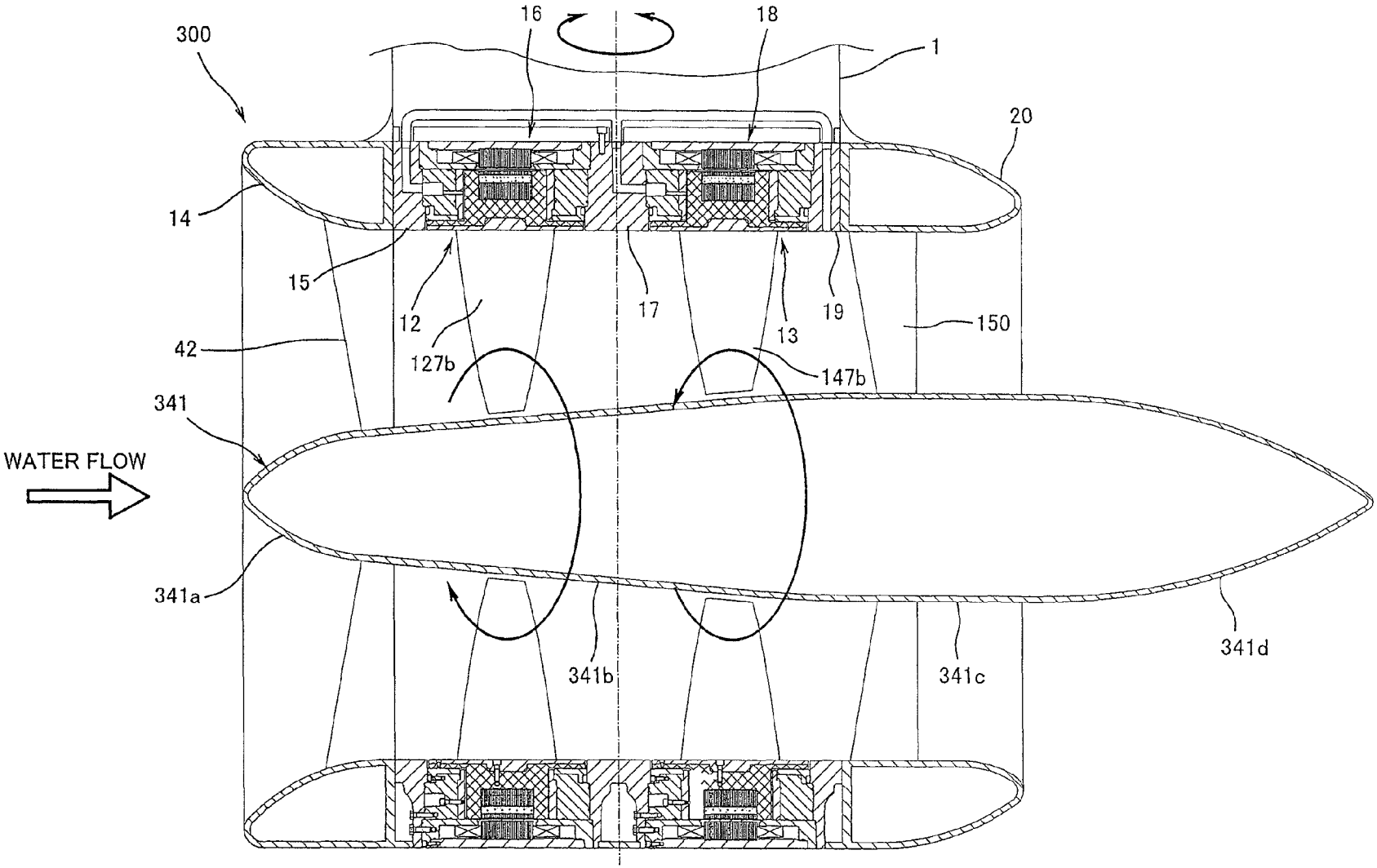
FIG. 8 is a vertical sectional view of a thrust generating apparatus according to a fourth embodiment of the present invention.

FIG. 8 is a vertical sectional view of a thrust generating apparatus 300 according to a fourth embodiment of the present invention. The constituents common to those in the previously described embodiments are designated by the same reference numerals and description thereof will be omitted. As shown in FIG. 8, the thrust generating apparatus 300 of the present embodiment includes a fixed boss 341 having a shape in which an outer diameter increases from upstream side to downstream side and is extended downstream beyond the downstream end of the stator 11.

The fixed boss 341 has a diameter-increasing front end portion 341*a* having a diameter increasing in the water flow direction, a conical cylindrical portion 341*b* extending from the downstream side of the diameter-increasing front end portion 341*a* and having an outer diameter increasing from upstream side toward downstream side, a cylindrical portion 341*c* extending from the downstream side of the conical cylindrical portion 341*b* and having a substantially equal outer diameter in the water flow direction, and a diameter-decreasing rear end portion 341*d* extending from the downstream side of the cylindrical portion 341*c* and having a diameter decreasing in the water flow direction. The upstream end of the fixed boss 341 substantially conforms in position in the water flow direction to the upstream end of the stator 11. The portion of the fixed boss 341 that protrudes downstream beyond the downstream end of the stator 11 is composed of a rear portion of the cylindrical portion 341*c* and the diameter-decreasing rear end portion 341*d*.

Embodiment 5

Figure 9:
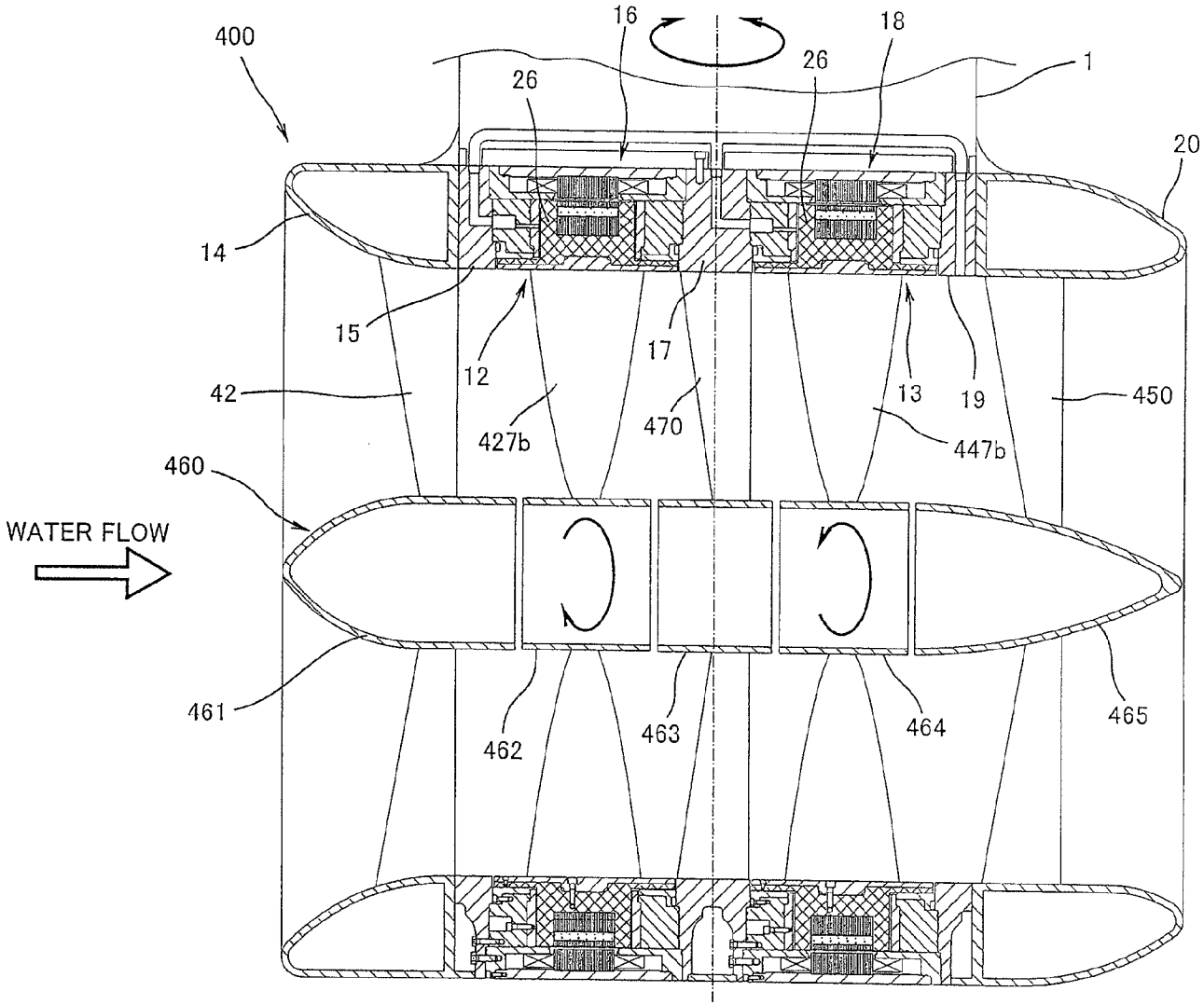
FIG. 9 is a vertical sectional view of a thrust generating apparatus according to a fifth embodiment of the present invention.

FIG. 9 is a vertical sectional view of a thrust generating apparatus 400 according to a fifth embodiment of the present invention. The constituents common to those in the previously described embodiments are designated by the same reference numerals and description thereof is omitted. As shown in FIG. 9, the thrust generating apparatus 400 of the present embodiment includes a boss assembly 460. The boss assembly 460 is composed of, in the order of from upstream to downstream, a front fixed boss 461, a front rotatable boss 462, an intermediate fixed boss 463, a rear rotatable boss 464, and a rear fixed boss 465 which are arranged in series, and the individual bosses are arranged in the water flow direction with a gap therebetween. In other words, the boss assembly 460 composed of the bosses 461 to 465 is configured to have an outer shape substantially identical to the shape of to the boss 41 of the first embodiment.

The front fixed boss 461 is fixed via the front guide vane 42 to the inflowing tubular body 14. The front rotatable boss 462 is connected to the radially inward tip end of the propeller vane 427*b* and is rotatable integrally with the propeller vane 427*b*. The intermediate fixed boss 463 is fixed via an intermediate guide vane 470 to the annular coupling member 17. The rear rotatable boss 464 is connected to the radially inward tip end of the propeller vane 447*b* and is rotatable integrally with the propeller vane 447*b*. The rear fixed boss 465 is fixed via a rear guide vane 450 to the outflowing tubular body 20. As the propeller vanes 427*b*, 447*b* are independently connected to different rotatable bosses 462, 464, respectively, the downstream propeller vane 447*b* is rotatable in the opposite direction to the rotation of the upstream propeller vane 427*b*.

According to the configuration as described above, since the propeller vanes 427*b*, 447*b* are coupled to the rotatable bosses 462, 464, respectively, the stiffness of the propeller vanes 427*b*, 447*b* is improved. Hence, the propeller vanes 427*b*, 447*b* are thinned, thereby enhancing the performance of the propeller vanes 427*b*, 447*b* and improving a propulsive capability. In an alternative example, in cases where the intermediate guide vane 470 is provided, a swirl flow outflowing from the upstream propeller vane 427*b* may be steered by the intermediate guide vane 470, and the downstream propeller vane 447*b* may be rotated in the same direction that the upstream propeller vane 427*b* rotates. This alternative example may be applied to the other embodiments.

Embodiment 6

Figure 10:
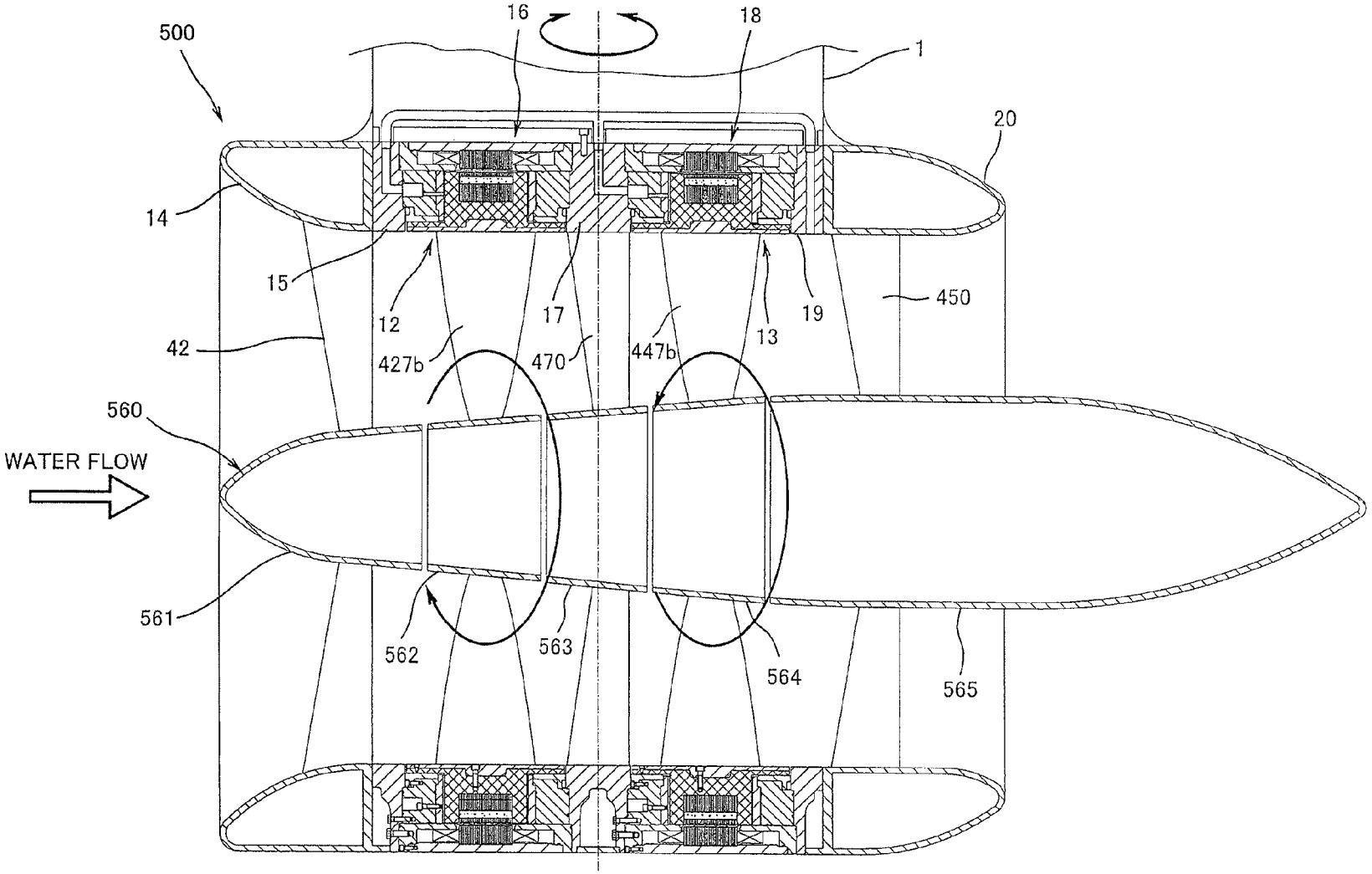
FIG. 10 is a vertical sectional view of a thrust generating apparatus according to a sixth embodiment of the present invention.

FIG. 10 is a vertical sectional view of a thrust generating apparatus 500 according to a sixth embodiment of the present invention. The constituents common to those in the previously described embodiments are designated by the same reference numerals and description thereof will be omitted. As shown in FIG. 10, the thrust generating apparatus 500 of the present embodiment includes a boss assembly 560 formed by modifying the boss assembly in the fifth embodiment (FIG. 9) to have a shape in which the outer diameter increases from upstream side toward downstream side and the boss assembly extends downstream beyond the downstream end of the stator 11.

The boss assembly 560 is composed of a front fixed boss 561, a front rotatable boss 562, an intermediate fixed boss 563, a rear rotatable boss 564, and a rear fixed boss 565 which are arranged in the order from upstream side to downstream side. The outer diameter of the boss assembly 560 increases from the front fixed boss 561 toward the rear rotatable boss 564. The fixed boss 565 protrudes downstream beyond the downstream end of the stator 11 and its diameter gradually decreases.

Embodiment 7

Figure 11:
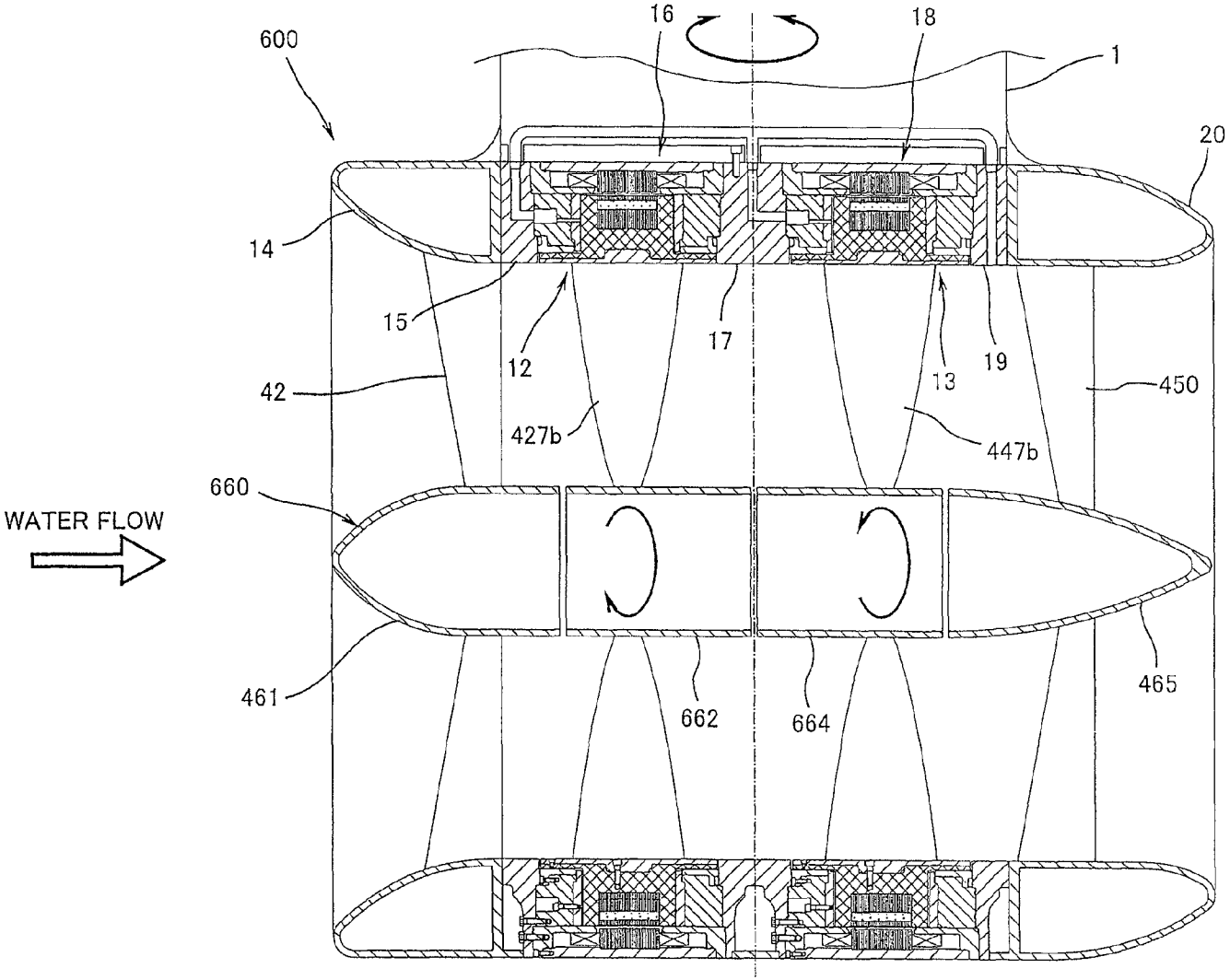
FIG. 11 is a vertical sectional view of a thrust generating apparatus according to a seventh embodiment of the present invention.

FIG. 11 is a vertical sectional view of a thrust generating apparatus 600 according to a seventh embodiment of the present invention. The constituents common to those in the previously described embodiments are designated by the same reference numerals and description thereof will be omitted. As shown in FIG. 11, the thrust generating apparatus 600 of the present embodiment is configured to omit the center guide vane 470 in the fifth embodiment (FIG. 9) which is provided between the propeller vanes 427*b*, 447*b*. Correspondingly, the intermediate fixed boss 463 is omitted from the configuration. To be specific, the boss assembly 660 of the present embodiment is configured such that the opposite surfaces of the front rotatable boss 662 and the rear fixed boss 664 are in close proximity to each other with a gap between them.

Embodiment 8

Figure 12:
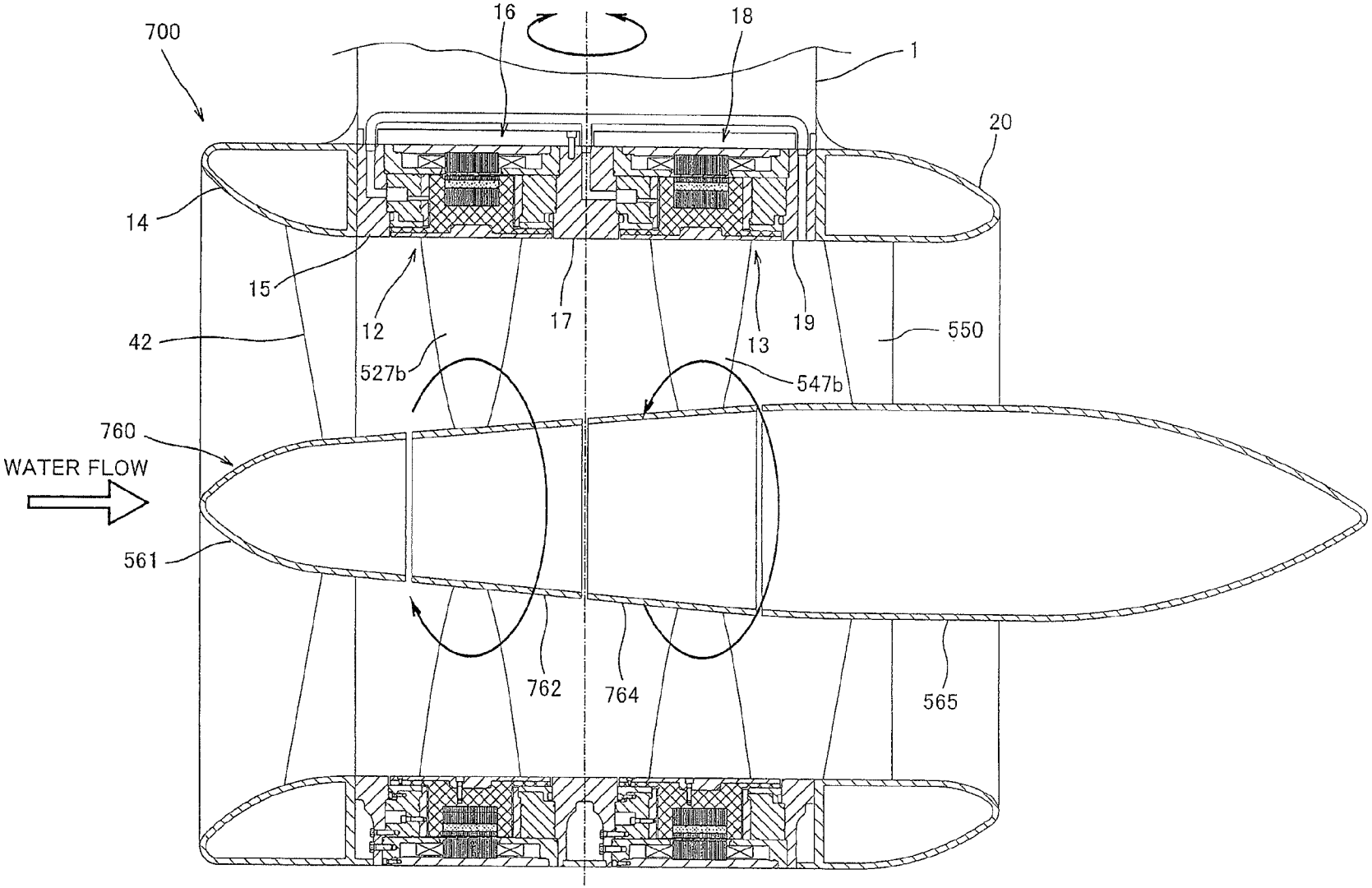
FIG. 12 is a vertical sectional view of a thrust generating apparatus according to an eighth embodiment of the present invention.

FIG. 12 is a vertical sectional view of a thrust generating apparatus 700 according to an eighth embodiment of the present invention. The constituents common to those in the previously described embodiments are designated by the same reference numerals and description thereof will be omitted. As shown in FIG. 12, the thrust generating apparatus 700 of the present embodiment includes a boss assembly 760 formed by modifying the boss assembly of the seventh embodiment (FIG. 11) to have a shape in which the outer diameter increases from upstream side toward downstream side and the boss assembly extends downstream beyond the downstream end of the stator 11.

The boss assembly 760 is composed of a fixed boss 561, a rotatable boss 762, rotatable boss 764, and a fixed boss 565 which are arranged in the order from upstream side to downstream side. The outer diameter of the boss assembly 760 increases from the fixed boss 561 toward the rotatable boss 764. The fixed boss 565 protrudes downstream beyond the downstream end of the stator 11 and gradually decreases in diameter.

Embodiment 9

Figure 13:
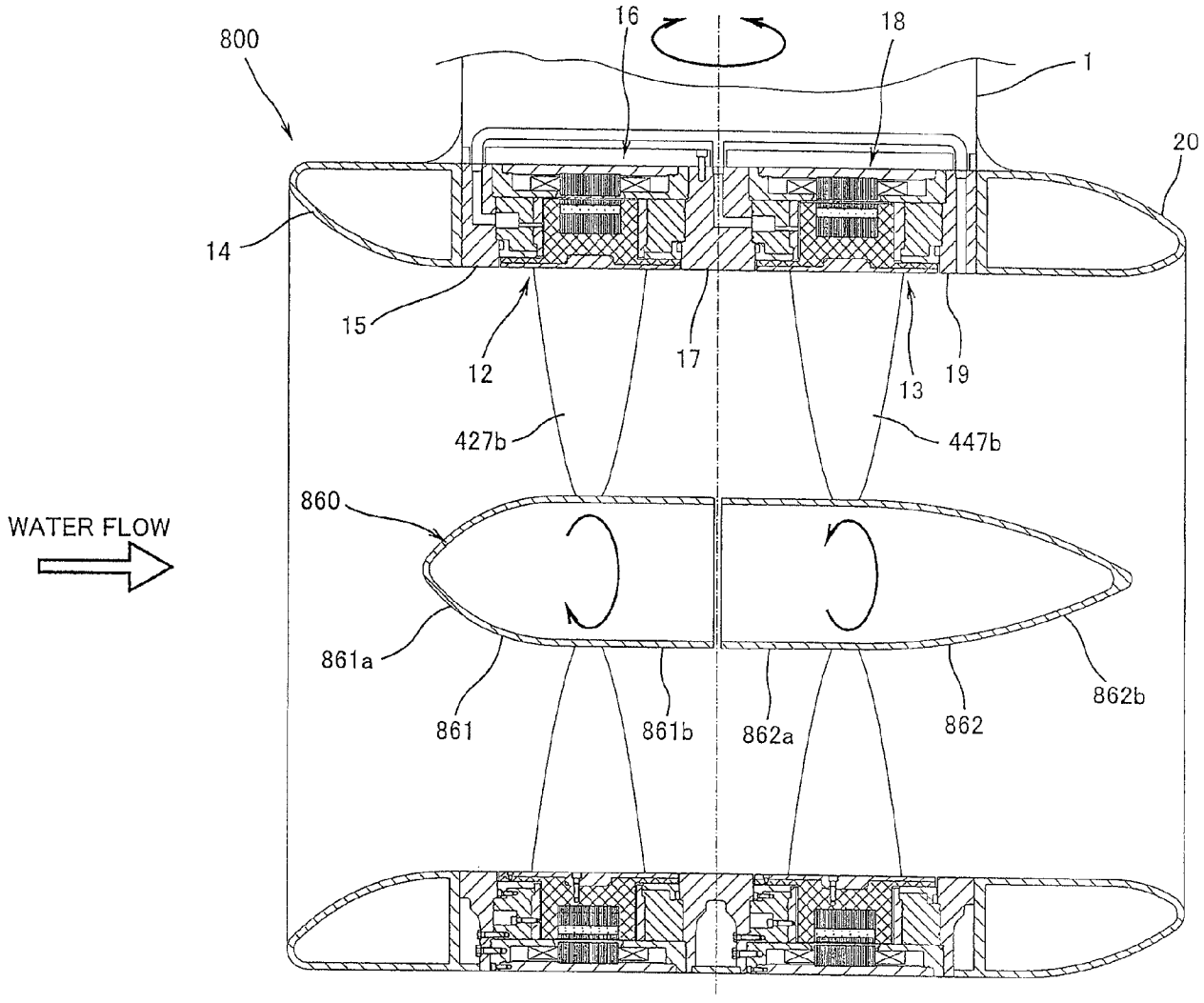
FIG. 13 is a vertical sectional view of a thrust generating apparatus according to a ninth embodiment of the present invention.

FIG. 13 is a vertical sectional view of a thrust generating apparatus 800 according to a ninth embodiment of the present invention. The constituents common to those in the previously described embodiments are designated by the same reference numerals and description thereof will be omitted. As shown in FIG. 13, the thrust generating apparatus 800 of the present embodiment is configured not to include a guide vane but to include a boss assembly 860. The boss assembly 860 is composed of a pair of rotatable bosses 861, 862 which are arranged in the water flow direction with a gap therebetween. The rotatable bosses 861, 862 are connected to the radially inward tip ends of the propeller vanes 427*b*, 447*b* and integrally rotate with the propeller vanes 427*b*, 447*b*, respectively. As the propeller vanes 427*b*, 447*b* are independently connected to rotatable bosses 861, 862, respectively, the downstream propeller vane 447*b* rotates in the opposite direction to the rotation of the upstream propeller vane 427*b*. In addition, the upstream end of the boss assembly 860 is located downstream of the upstream end of the stator 11, and the downstream end of the boss assembly 860 is located upstream of the downstream end of the stator 11.

Embodiment 10

Figure 14:
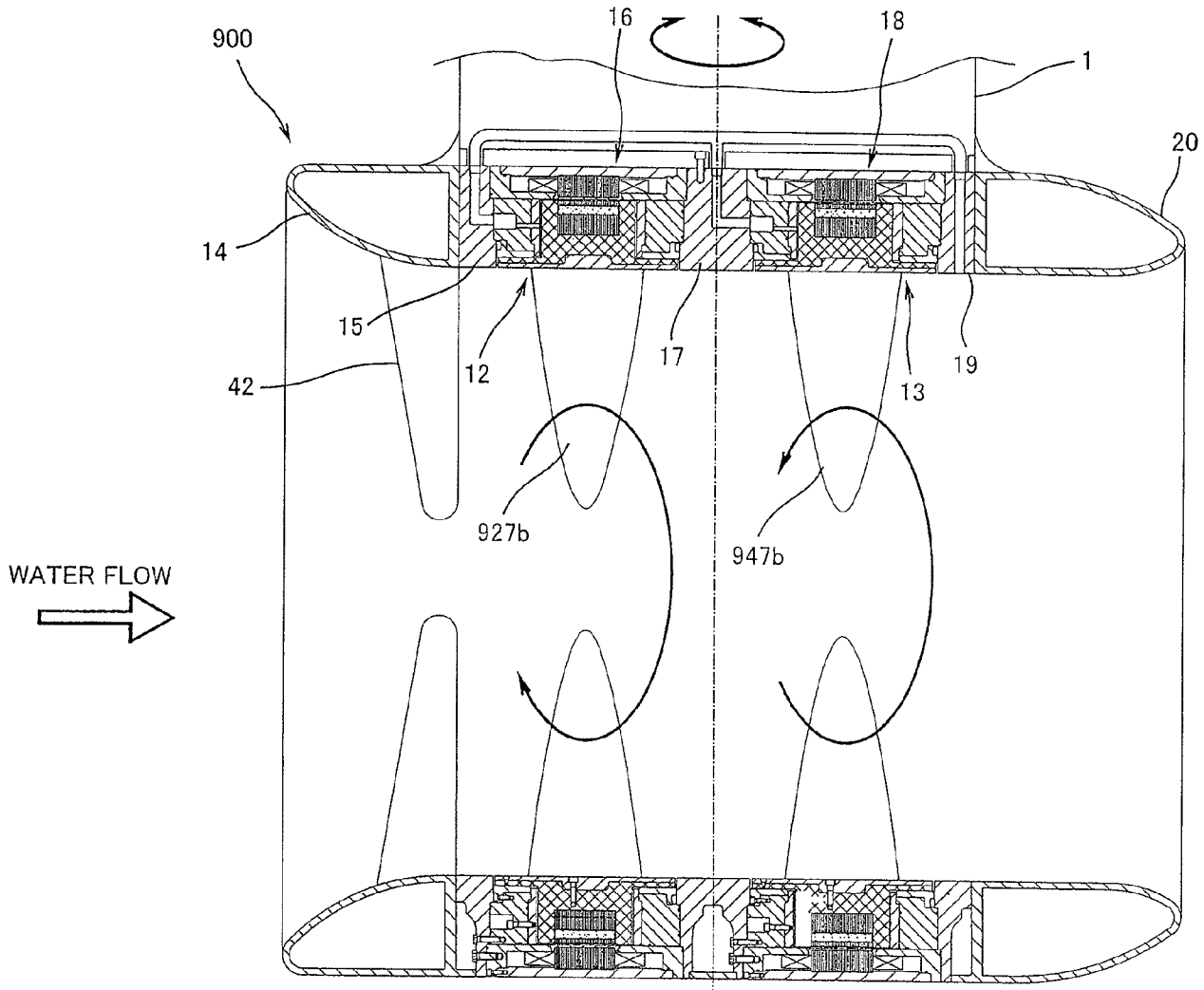
FIG. 14 is a vertical sectional view of a thrust generating apparatus according to a tenth embodiment of the present invention.

FIG. 14 is a vertical sectional view of a thrust generating apparatus 900 according to a tenth embodiment of the present invention. The constituents common to those in the previously described embodiments are designated by the same reference numerals and description thereof will be omitted. As shown in FIG. 14, the thrust generating apparatus 900 of the present embodiment is configured not to include a boss on the center axes of the rotors 12, 13. Correspondingly, the radially inward tip ends of the guide vane 42 and of the propeller vanes 927*b*, 947*b* are free ends. With this configuration, the weight of the whole apparatus may be reduced, because of the absence of a boss.

Although the thrust generating apparatus of each embodiment as described hereinbefore has been described, by way of example, as being mounted to a standard vessel, it may be applied to any mobile object capable of relative movement on or under water with respect to the water, such as a submersible vessel, tugboat, research vessel or oil-drilling rig which rests at a certain location on water, or the like.

The invention claimed is:

1. A thrust generating apparatus which is positioned under water and configured to generate a thrust by ejecting water, comprising:

a duct-shaped stator provided with a plurality of coils and a plurality of ring-shaped casings, the plurality of ring-shaped casings accommodating the plurality of coils respectively and being arranged in series in a water flow direction; and a plurality of ring-shaped rotors which are arranged radially inward relative to the stator, provided with magnets respectively corresponding to the plurality of coils and arranged in series in a rotational axis direction thereof, each of the rotors having a propeller vane protruding radially inward; wherein a radially inward tip end of the propeller vane forms a free end, the plurality of casings accommodating the plurality of coils respectively and the plurality of rotors provided with the magnets and the propeller vane constitute a plurality of motor units respectively;

the plurality of motor units are coupled to each other in series in the water flow direction such that the plurality of motor units are individually dismountable;

the stator has an annular coupling member which is formed on its outer peripheral surface with a concave portion, the annular coupling member being disposed between casings of the motor units; and the plurality of motor units are coupled to each other in series in the water flow direction by fastening both side walls of the concave portion to the casings of the motor units by bolts respectively.

2. The thrust generating apparatus according to claim 1, wherein the plurality of rotors are configured such that the propeller vane on a downstream side rotates in an opposite direction to rotation of the propeller vane on an upstream side.

3. The thrust generating apparatus according to claim 1, further comprising a boss positioned along a center axis of the rotors.

4. The thrust generating apparatus according to claim 3, wherein the boss is a fixed boss connected to the stator, and the fixed boss has a diameter smaller than a diameter defined by the radially inward tip ends of the propeller vanes, and a plurality of propeller vanes are configured to rotate along an outer peripheral surface of the fixed boss.

5. The thrust generating apparatus according to claim 4, further comprising a guide vane configured to guide water to the propeller vanes, wherein the guide vane is fixedly mounted to couple the stator to the fixed boss.

6. The thrust generating apparatus according to claim 3, wherein the boss has a shape in which an outer diameter increases from an upstream side to a downstream side.

7. The thrust generating apparatus according to claim 3, wherein the boss is extended to protrude in a downstream direction beyond a downstream end of the stator.

8. The thrust generating apparatus according to claim 1, wherein the stator includes the plurality of ring-shaped casings configured to respectively accommodate the plurality of coils and an annular coupling member interposed between the casings and having a concave portion formed in an outer peripheral surface thereof, wherein side walls of the concave portion of the annular coupling member and the casings are fastened together with bolts.

9. A thrust generating apparatus which is positioned under water and configured to generate a thrust by ejecting water, comprising:

a duct-shaped stator provided with a plurality of coils;

a plurality of ring-shaped rotors which are arranged radially inward relative to the stator and provided with magnets respectively corresponding to the plurality of coils, the plurality of rotors being arranged in series in a rotational axis direction thereof and each of the rotors having a propeller vane protruding radially inward;

a water-lubricated bearing which is disposed to face a side surface and outer peripheral surface of the rotor and configured to sustain loads in a thrust direction and in a radial direction;

a water intake which is formed in the stator at a position downstream of the propeller vanes and configured to take in water that has passed through the propeller vanes; and a water guide pipe configured to guide water that flows into the water intake to the water-lubricated bearing.

10. The thrust generating apparatus according to claim 9, wherein the water guide pipe is connected to a water discharge hole formed in an end surface of the water-lubricated bearing which is opposite to an upstream end surface of the rotor.

11. The thrust generating apparatus according to claim 9, wherein the water guide pipe is configured to be positioned inside an object in a state where the thrust generating apparatus is mounted to the object.

12. The thrust generating apparatus according to claim 1, wherein the annular coupling member has a mounting portion which is formed on its outer peripheral surface and provided to make the concave portion discontinuous at a portion thereof in a circumferential direction.

13. The thrust generating apparatus according to claim 12, wherein the mounting portion is formed with a bolt hole for fastening the annular coupling member to a strut.

14. The thrust generating apparatus according to claim 12, wherein the mounting portion is formed with a water guide passage which guides water to a water-lubricated bearing.

15. The thrust generating apparatus according to claim 1, wherein the concave portion is closed with a cover.

* * * * *